US009560880B2

(12) United States Patent
Aspgren

(10) Patent No.: US 9,560,880 B2
(45) Date of Patent: Feb. 7, 2017

(54) CONTAINER WITH REMOVABLE ADHESIVELY HELD PACKETS

(71) Applicant: Swedish Match North Europe AB, Stockholm (SE)

(72) Inventor: Thom Aspgren, Hisings Backa (SE)

(73) Assignee: Swedish Match North Europe AB, Stockholm (SE)

( * ) Notice: Subject to any disclaimer, the term of this patent is extended or adjusted under 35 U.S.C. 154(b) by 0 days.

(21) Appl. No.: 14/397,627

(22) PCT Filed: May 24, 2013

(86) PCT No.: PCT/EP2013/060774

§ 371 (c)(1),
(2) Date: Oct. 28, 2014

(87) PCT Pub. No.: WO2013/174991

PCT Pub. Date: Nov. 28, 2013

(65) Prior Publication Data

US 2015/0122675 A1 May 7, 2015

Related U.S. Application Data

(60) Provisional application No. 61/651,686, filed on May 25, 2012.

(30) Foreign Application Priority Data

May 25, 2012 (EP) ..... 12169585

(51) Int. Cl.

| | |
|---|---|
| ***A24F 23/02*** | (2006.01) |
| ***A24F 23/00*** | (2006.01) |
| ***B65B 5/06*** | (2006.01) |

(52) U.S. Cl.
CPC ..... *A24F 23/02* (2013.01); *A24F 23/00* (2013.01); *B65B 5/06* (2013.01)

(58) Field of Classification Search
CPC ..... A24F 23/00; A24F 23/02; A24F 23/04; A24F 13/00

(Continued)

(56) References Cited

U.S. PATENT DOCUMENTS 6,499,596 B1 * 12/2002 Andersen ..... B65B 15/00 206/460
7,032,754 B2 * 4/2006 Kopecky ..... B65D 71/0085 206/460

(Continued)

FOREIGN PATENT DOCUMENTS

WO WO 2010/066510 6/2010

OTHER PUBLICATIONS

Sep. 30, 2013 Int'l Search Report for related PCT/EP2013/060774 (2 pages).

*Primary Examiner* — Bryon Gehman
(74) *Attorney, Agent, or Firm* — Knobbe Martens Olson & Bear LLP

(57) ABSTRACT

The present invention provides a container comprising portion packets of a tobacco or non-tobacco snuff, wherein the portion packets are held in place on an interior surface of the container by an adhesive, a method for packing portion packets of a tobacco or non-tobacco snuff in a container, as well as use of an adhesive in such container for removable adhesion of said portion packets.

13 Claims, 2 Drawing Sheets

(a)

(b)

(58) Field of Classification Search
USPC ..... 206/236, 242–275, 460, 813
See application file for complete search history.

(56) References Cited

U.S. PATENT DOCUMENTS

| | | | | |
|---|---|---|---|---|
| 7,159,717 | B2 * | 1/2007 | Aldridge | B65D 5/009 206/800 |
| 7,325,686 | B2 * | 2/2008 | Aldridge | B65D 85/60 206/460 |
| 7,798,319 | B1 * | 9/2010 | Bried | A24F 23/00 206/242 |
| 8,118,165 | B2 * | 2/2012 | Duvekot | B65D 5/04 206/264 |
| 8,550,093 | B2 * | 10/2013 | Saint-Girons | B65D 75/5844 206/265 |
| 8,931,493 | B2 * | 1/2015 | Sebastian | A24B 13/00 131/352 |
| 9,066,540 | B2 * | 6/2015 | Atchley | A24B 15/28 |
| 9,445,631 | B1 * | 9/2016 | Patel | A24F 23/00 |
| 2008/0142392 | A1 | 6/2008 | Aldridge | |
| 2008/0173317 | A1 * | 7/2008 | Robinson | A24F 23/02 131/352 |
| 2010/0018882 | A1 * | 1/2010 | St. Charles | A24F 23/00 206/242 |
| 2010/0018883 | A1 * | 1/2010 | Patel | A24B 13/00 206/256 |
| 2010/0187143 | A1 * | 7/2010 | Essen | A24B 13/00 206/260 |
| 2010/0187145 | A1 * | 7/2010 | Mezzini | B65D 85/60 206/460 |

* cited by examiner (a) (b)

(a)

(b)

CONTAINER WITH REMOVABLE ADHESIVELY HELD PACKETS

CROSS REFERENCE TO RELATED APPLICATIONS

This application is a U.S. National Phase application of PCT International Application Number PCT/EP2013/060774, filed on May 24, 2013, designating the United States of America and published in the English language, which is an International Application of and claims the Benefit of priority to European Patent Application No. 12169585.2, filed on May 25, 2012, and U.S. Provisional Application No. 61/651,686, filed on May 25, 2012. The disclosures of the above-referenced applications are hereby expressly incorporated by reference in their entities.

The present invention relates to a container comprising portion packets of a tobacco or non-tobacco snuff composition, wherein the portion packets are held in place in an interior of the container by an adhesive, a method for packing portion packets of a tobacco or non-tobacco snuff composition in said container, as well as use of an adhesive in said container for removable adhesion of said portion packets.

TECHNICAL BACKGROUND

Tobacco or non-tobacco smokeless products for oral use comprise finely divided, particulate, such as ground, or cut, tobacco or non-tobacco material or a combination thereof that is not intended for combustion but designed to be placed in the oral cavity of a user for a period of time. There are many various forms of smokeless products for oral use, such forms include tobacco and non-tobacco snuff.

Tobacco snuff is available as dry snuff for oral or nasal use and moist (or wet) snuff for use in the oral cavity by placing between the lip and gum. There are two types of moist snuff, the American and the Scandinavian type. American-type moist snuff is available in a loose form or as pre-packed pouches and is typically used between the lower gum and lip. The use of American-type moist snuff is commonly called dipping. Snus is the Scandinavian-type of moist snuff that is available in loose form or is portion packed in pouches and is typically used between the upper gum and lip. Non-tobacco snus for oral use is also commonly portion packed in pouches and placed between the upper gum and lip.

Tobacco or non-tobacco moist snuff may be provided in different forms of portion packets, such as in pouches. Manufacturing of such portion packets generally involve the steps of (pre)treating and processing of the tobacco or non-tobacco material; forming portion-sized packets of the bulk material; optionally wrapping a packaging material around the portion packets; and placing the portion packets in a container.

The production rate of moist snuff for oral use in portion packets is very high; typically several hundreds of portion packets per minute. There are a number of requirements concerning packing of portion packets in a container that are important to the end user and also for obtaining an efficient packing. For example, the portion packets may be positioned in a certain pattern in a container to confer an attractive appearance to the user and at the same time obtain an optimum use of the space in the container.

Thus, there is still a need of improved packing techniques of portion packets of a tobacco or non-tobacco moist snuff in a container in order to comply with the demands posed from the end users as well as from the manufacturing perspective.

SUMMARY OF THE INVENTION

The present invention provides a container comprising portion packets of a tobacco or non-tobacco snuff, wherein the portion packets are held in place in an interior of the container by an adhesive, a method for packing the portion packets in the container, as well as use of an adhesive in a container for removable adhesion of portion packets of a tobacco or non-tobacco moist snuff.

The container comprising portion packets of a tobacco or non-tobacco snuff, the method for packing portion packets in a container and use of an adhesive in a container according to the present invention are defined in the appended claims.

Hence, in a first aspect, the present invention provides a container comprising portion packets of a tobacco or non-tobacco snuff composition having a water content from about 10 wt % to about 90 wt % of the total weight of the final composition, wherein said portion packets are individually wrapped in a permeable material and held in place on an interior surface of the container by an adhesive.

In a second aspect, the present invention provides a method for packing portion packets of a tobacco or non-tobacco snuff composition having a water content from 10 wt % to 90 wt % of the total weight of the final composition in a container according to the first aspect, comprising:

a) applying an adhesive on an interior surface of a container;
b) providing portion packets of a tobacco or non-tobacco snuff composition having a water content from 10 wt % to 90 wt % based on the total weight of the final composition, wherein said portion packets are individually wrapped in a permeable material;
c) placing the individually wrapped portion packets from step b) into the container in a desired pattern, whereby a contact is established between each of said individually wrapped portion packets and the container at the point where the adhesive has been applied; and
d) sealing the container.

In a third aspect, the present invention provides use of an adhesive on an interior surface of a container for removable adhesion of portion packets of a tobacco or non-tobacco snuff composition having a water content from 10 wt % to 90 wt % based on the total weight of the final composition, wherein said portion packets are individually wrapped in a permeable material.

DETAILED DESCRIPTION OF THE INVENTION

Figure 1:
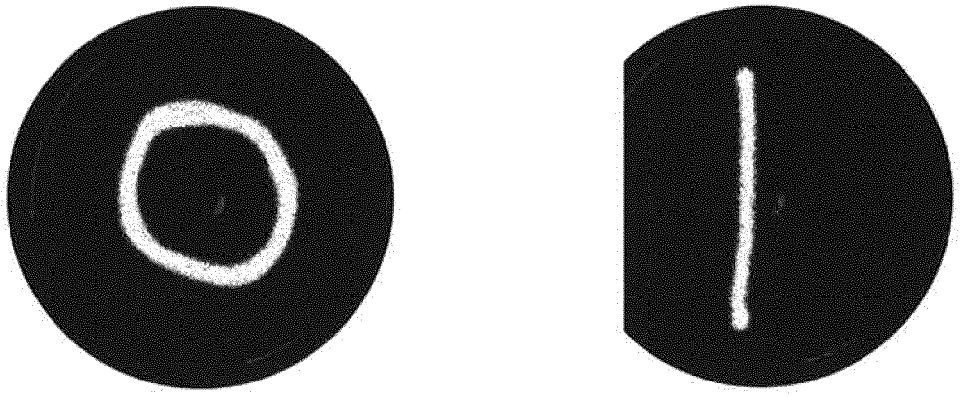
FIGS. 1 (*a*) and (*b*) show an example of an adhesive strand applied in a container.

By "tobacco" is meant any part, e.g., leaves and stems, of any member of the genus *Nicotiana*. The tobacco may be whole, shredded, threshed, cut, ground, cured, aged, fermented, or otherwise, e.g. granulated or encapsulated. Tobacco may also be in the form of finished products, including any smokeless tobacco compositions that are orally consumed. Such smokeless tobacco compositions include snuff and chewing tobacco. Snuff is available in two forms, as dry nasal snuff for sniffing, and moist (or wet) snuff, such as snus, for use in the oral cavity by placing between the lip and gum. Snuff is provided in a particulate form, optionally as portion packets.

"Oral" and "oral use" is in all contexts used herein as a description for use in the oral cavity, i.e. chewing purposes, or buccal placement.

By "non-tobacco" snuff is meant a snuff composition that does not comprise tobacco but resembles tobacco snuff in that it have similar texture, color, taste, flavor and feeling. Non-tobacco snuff compositions are usually based on non-tobacco plant fibers.

The terms "snuff" and "snuff composition" are used interchangeably throughout the present specification.

Snuff can have a water content ranging from around 10 wt % for very dry products up to around 90 wt % based on the total weight of the final snuff composition. Moist snuff typically has a water content from about 20 wt % to about 60 wt %.

American-type moist snuff, commonly called dipping tobacco, for oral use is commonly produced through a fermentation process of moisturized ground or cut tobacco. American-type moist snuff is available in a loose form or as pre-packed pouches and is most commonly used between the lower gum and lip but could also be used as snus between the upper gum and lip. The water content is typically higher than 40 wt %.

"Snus" as used herein denotes the Scandinavian type of moist snuff for oral use, which is produced in a heat-treatment process instead of by fermentation. The product may be provided in particulate form, as a loose powder, or portion packed in a pouch. The final water content is typically higher than 40 wt %, but semi-dry products having less than 40 wt % water content are also available. Snus is typically used between the upper gum and lip.

"Portion packets" of a tobacco or non-tobacco snuff is used herein for pre-formed portions of tobacco or non-tobacco snuff.

Portion packets of a tobacco or non-tobacco snuff composition may be wrapped in a permeable material, such as a permeable membrane. A permeable membrane is a thin structure which serves as a selective barrier between two phases and remains impermeable to specific particles, molecules, or substances when exposed to the action of a driving force. Exemplary permeable materials are permeable to saliva and compounds from a tobacco or non-tobacco snuff composition that are extracted by saliva. Permeable materials suitable for the present invention are selected from flexible materials and stretchy materials. The permeable materials may be made of polymers or natural fibres such as cellulose fibres. The permeable material may be a fabric, including woven and non-woven materials. The non-woven material may be a standard cellulose based non-woven fabric such as viscose. One common example of portion packets wrapped in a permeable material is pouches of moist snuff, such as snus pouches.

"Fabric", as used herein, refers to any material made through weaving, knitting, spreading, crocheting, pressing or bonding fibres together, including thread or yarn. The term "non-woven material" as used herein denotes a fabric made from long fibres, bonded together by chemical, mechanical, heat or solvent treatment.

The tobacco or non-tobacco snuff composition used in the present invention may have a water content from 10 wt % to 90 wt % based on the total weight of the final composition, or the water content may be from 20 wt % to 60 wt %, such as from 28 wt % to 56 wt %.

Throughout this specification the term "adhesive" is used for a material that adheres or bonds items together. The adhesive may be in a liquid or semi-liquid state. The adhesives may originate from either natural or synthetic sources and may be non-reactive, or reactive.

Non-reactive adhesives are drying adhesives, which harden by drying and includes, but are not limited to, solvent based adhesives and polymer dispersion adhesives, also known as emulsion adhesives; pressure sensitive adhesives (PSAs) that form a bond by the application of light pressure to marry the adhesive with the adherend, and is usually based on an elastomer, which may be compounded with a suitable tackifier, such as ethylene-vinyl acetate (EVA), styrene-butadiene-styrene (SBS), styrene-isoprene-styrene (SIS), and other styrene-block-copolymers (SBC), bio-based acrylate, or natural rubber; contact adhesives, for example made of natural rubber or polychloroprene (neoprene); and hot-melt adhesives, such as adhesives based on polyesters of lactic acid, starch, cellulose, collagen or mixtures thereof, thermoplastic polyurethane (TPU), polyamides (PA), polycaprolactone with soy protein, ethylene-vinyl acetate (EVA), ethylene-acrylate copolymers, and styrene block copolymers (SBC), such as styrene-ethylene/butylene-styrene (SEBS), styrene-butadiene-styrene (SBS), styrene-isoprene-styrene (SIS), and styrene-ethylene/propylene (SEP).

Reactive adhesives includes, but are not limited to, multi-component adhesives that harden by mixing two or more components which chemically react, such as combinations of polyester resins and polyurethane resins, polyols and polyurethane resins, and acrylic polymers and polyurethane resins; and one-part adhesives that harden by a chemical reaction with an external energy source, such as radiation, heat, and moisture.

Natural adhesives refer to adhesives made from organic sources such as vegetable matter, starch (dextrin), natural resins or from animals e.g. casein or animal glue. Natural adhesives are often referred to as bioadhesives. Synthetic adhesives are based on elastomers, thermoplastics, emulsions, and thermosets. Examples of thermosetting adhesives are epoxy, polyurethane, cyanoacrylate and acrylic polymers.

The portion packets of tobacco or non-tobacco snuff composition according to the present invention are individually wrapped in a permeable material. The permeable material may be a fabric. The fabric may be selected from woven and non-woven materials. An example of a non-woven material is a cellulose based non-woven material, such as viscose. The individually wrapped portion packets may be pouches comprising moist snuff, such as snus pouches.

Portion packets of a tobacco or non-tobacco snuff composition that are individually wrapped in a fabric, such as a non-woven material, for example snus pouches, usually have a soft, pliable and/or somewhat sticky texture and are therefore relatively difficult to handle in automated processes with a high production rate, typically several hundreds of portion packets per minute. For example, when the individually wrapped portion packets, such as snus pouches, are loaded into the container they may slip out of the container and get jammed before the container is closed, causing loss and possibly periods of downtime in the production.

An advantage with a container according to the present invention is that the portion packets of a tobacco or non-tobacco snuff composition are held in place by an adhesive when they are positioned in the container and are therefore less prone to slip out of the container during production. Thus, the present invention enables reduced waste and downtime in the production.

Portion packets of a tobacco or non-tobacco snuff composition may be positioned in a certain pattern in a container to confer an attractive appearance to the user and to provide efficient packing. By positioning the portion packets in a desired pattern in the container, the portion packets can be packed in a more efficient way, both regarding time, for example by increased production speed, and space, for example by a geometrically efficient packing. In general, the size and shape of the container is adapted to the desired pattern of the portion packets, so that the pattern of the portion packets are held in place by support from the bottom surface and surrounding walls of the container having a shape adapted to support the pattern. However, when a portion packet is taken out, the pattern tends to collapse giving a less attractive impression to the consumer. Also, the portion packets of a tobacco or non-tobacco snuff composition wrapped in a non-woven material may adhere to each other, making them difficult to handle individually.

An advantage of the present invention wherein portion packets are held in place on an interior surface of the container by an adhesive is that the portion packets may be kept in a desired pattern regardless of the shape of the container. Further, the portion packets may keep their original position in the pattern, so that the pattern does not collapse even when one or more portion packets are taken out from the container.

Consumers of tobacco or non-tobacco snuff composition usually bring the container comprising said product with them all day. The container may be jostled around, for example in a pocket or a handbag, and is often subjected to mechanical stress, e.g. when located in the front or back pocket of the consumer's pants and he or she sits down. The adhesive used in the present invention enables the portion packets to remain in the original pattern during the entire use of the product. Thus, the attractive appearance to the consumer may be kept even after the initial use of the product and until the last portion is taken out. In addition, also damage of the portion packets, especially during use of the container, is prevented due to the present invention.

Another advantage with the present invention is that the adhesive prevents the portion packets to fall out of the container, when the lid is opened and the container is dropped or turned upside down.

A further effect of the present invention is that the pattern of the portion packets does not need to fit the surrounding walls of the container or to be supported by any interior partition walls in the container. Thus, the container used for storing the portion packets of the tobacco or non-tobacco snuff composition may have any desired form. Thus, the geometrical form of the container becomes independent of the desired pattern for the portion packets. Further, the container does not need to have interior partition walls. The applied pattern remains intact during manufacturing, storage, transportation and during the entire use.

The container according to the present invention, may have any desired shape or geometrical form, for example in the form of a circle; a half circle; or a regular polygon, such as a triangle, a square, a rectangle, a regular pentagon, a regular hexagon, an regular octagon, or oval or the like; a reuleux polygon, such as a triangle with curved sides; or an irregular shape, for example a polygon with different side lengths and/or different angles of the corners, or as a circular segment, such as with a curved side and one or more straight sides, as shown in FIG. 1(*b*).

The container according to the present invention may comprise a top and a base defining an interior space. For example the base may comprise a base surface and surrounding walls extending from said base surface. The top may be in the form of a lid that is detachable from the base of the container, or in the form of a lid that is hinged to the base of the container, or rotatable with respect to the base of the container.

The container may comprise a base surface and surrounding walls extending from said base surface, and may be sealed with a liner covering the open end of the container. The liner can be used in combination with a lid.

The container may also comprise a dosing aperture. The dosing aperture may be placed anywhere on the container, such as at the top, such as the lid, or in the wall of the container. The dosing aperture may have any desired form suitable for dosing the portion packets from the container.

An effect of the present invention, wherein the portion packets are held in place by an adhesive in a container with a dosing aperture, is that the portion packets are held in place in their original positions so that the portion packets may not be jammed in the dosing aperture when said aperture is closed.

The container according to the present invention may be a snuff box.

A further effect of using an adhesive in the container according to the present invention is that it enables positioning of the portion packets in any desired pattern. An example of possible patterns is shown in FIG. 2.

Figure 2:
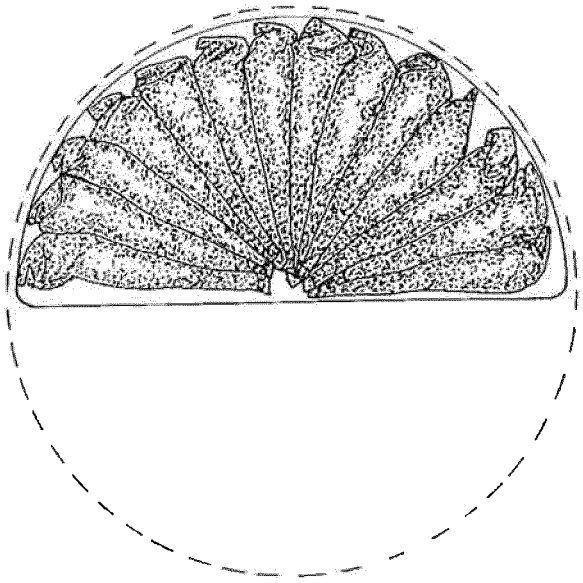
FIGS. 2 (*a*) and (*b*) show an example of portion packets placed in a certain pattern in a container.
Figure 2:
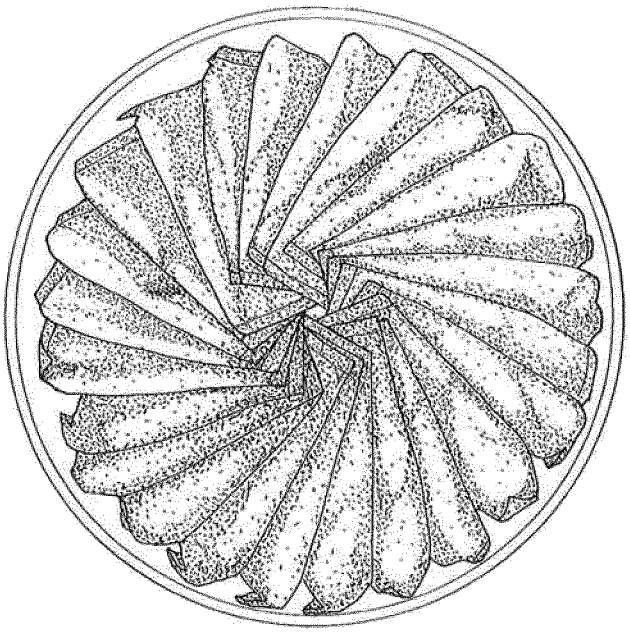

Further, the portion packets may be laid down in the container with their flat side facing the base or the portion packets may be set on their edges as illustrated in FIG. 2. Alternatively, the portion packets are set on their edges when they are positioned in the container.

Preferably, each wrapped portion packet is in contact with the container at a point where the adhesive has been applied on the interior surface.

The adhesive used in the present invention may be applied on an interior surface of the container, for example the base surface, the surrounding walls, or the interior surface of a lid, for example the adhesive may be applied on the interior base surface of the container.

The container may comprise more than one layer, such as two layers, of portion packets of the snuff composition, wherein the portion packets in the lower layer are adhered to the interior base surface of the container, and the portion packets in the upper layer are adhered to the inside of the top surface of the container.

The adhesive may be applied on each wrapped portion packet of the tobacco or non-tobacco snuff composition before they are placed in the container.

The adhesive can be applied on an interior surface of the container in the form of one or more strands, such as one, two or three strands. The strand can be a continuous line, or a dotted line. The strand may have any desired form, for example a straight line, a wave-formed line, a star, a spiral, a circle or a half circle. An example of adhesive strands applied in a container is illustrated in FIG. 1.

The adhesive may also be smeared out on or sprayed on an interior surface of the container.

The adhesive can also be applied on an interior surface of the container in the form of a double-sided adhesive tape.

Portion packets of tobacco or non-tobacco snuff composition wrapped in a non-woven material as in the present invention are soft and pliable. The adhesive used in the present invention possesses adequate adhesion force to hold the wrapped portion packets in place inside the container during manufacturing and when one wrapped portion packet is taken out from the container by a consumer, while at the same time the adhesive permits removal of desired portion packets without causing rupture of the material wrapping the portion packets. The adhesion force of an adhesive depends on the amount used as well as its inherent tackiness.

The adhesive used in the present invention permits removable adhesion of the portion packets. An example of an adhesive for removable adhesion of portion packets of tobacco or non-tobacco snuff composition wrapped in a non-woven material according to the present invention, such as snus pouches, is Dispofix™ Cool 600.

Since the tobacco or non-tobacco snuff composition according to the present invention is for oral use, the adhesive should be suitable for oral use and preferably comply with national food acts. In certain jurisdictions, such as Sweden and the United States, snuff products are regulated, and thus the adhesive needs to fulfil regulation requirements. Further, the adhesive must be compatible with the snuff composition and posses no properties deleterious to flavour or appearance of the product.

The adhesive holding the portion packets in place in the container is preferably not transferred to the portion of the tobacco or non-tobacco snuff composition, not even traces of it, when the portion packet is removed from the container.

It is further preferred that the adhesive does not penetrate the permeable wrapping material.

The adhesive may be a pressure sensitive adhesive (PSA), such as a styrene-block-copolymer (SBC), butyl rubber, or ethylene-vinyl acetate (EVA), and acrylics, such as a bio-based acrylate.

The adhesive may also be hot melt adhesive, such as styrene-block-copolymers (SBC), for example styrene-ethylene/butylene-styrene (SEBS); adhesives based on polyesters of lactic acid, starch, cellulose, collagen or mixtures thereof; polyvinyl acetate resins and copolymers, for example ethylene-vinyl acetate (EVA); and acrylic copolymers, for example ethylene-acrylate copolymers. Preferably the hot melt adhesive is a styrene-block-copolymer (SBC).

The adhesive may be made from an organic source such as vegetable matter or from animals; such as carbohydrates, for example starch, cellulose, amylopectin, and derivatives thereof, such as polylactic acid; proteins, for example collagen, gelatine and casein; and glycoprotein.

The adhesive used in the present invention may be a pressure sensitive hot melt adhesive.

Thus, the container according to the present invention comprises portion packets of a tobacco or non-tobacco snuff composition having a water content from 10 wt % to 90 wt % based on the total weight of the composition, or from 20 wt % to 60 wt %, such as from 28 wt % to 56 wt %, such as moist snuff, for example snus; wherein said portion packets are individually wrapped in a permeable material, such as a fabric, and are held in place on an interior surface of the container by an adhesive, such as an adhesive permitting removable adhesion of the portion packets in the container.

The fabric used for wrapping the portion packets may be selected from woven and non-woven materials, wherein an example of a non-woven material is a cellulose based non-woven material, such as viscose.

An example of the present invention is a container comprising portion packets of snus, wherein said portion packets are individually wrapped in a cellulose based non-woven material, and held in place on an interior surface of the container by an adhesive permitting removable adhesion of the portion packets in the container.

Manufacturing processes for tobacco or non-tobacco snuff composition in pouches are well known to the person skilled in the art, and any known process thereof may be used.

A general description of snus manufacturing is presented by e.g. ESTOC, European Smokeless Tobacco Council, and the GothiaTek® quality standard for snus. Methods for the manufacture of American type moist snuff are described in e.g. Wahlberg, I., Ringberger, T. (1999) Smokeless Tobacco. In: Tobacco: *Production, Chemistry and Technology*, (eds D. L. Davis & M. T. Nielsen) pp. 452-460, World Agriculture Series, Blackwell Science Ltd. Manufacturing of non-tobacco moist snuff is usually adapted to the procedure of manufacturing of tobacco moist snuff, with the difference that tobacco is replaced by non-tobacco raw material.

Manufacturing of portion packets of a tobacco or non-tobacco snuff, such as pouches comprising snus, generally involve the steps of (pre)treating and processing of the tobacco or non-tobacco material, for example grinding, pasteurizing, mixing with additives, and moistening; forming portion packets of the bulk material; optionally wrapping a packaging material, such as a standard cellulose based non-woven fabric for snus, around the portion packets; and placing the obtained portion packets in a container.

The portion packets of the present invention may be provided by a forming arrangement configured to form portion-sized packets of a tobacco or non-tobacco snuff composition having a water content from 10 wt % to 90 wt % based on the total weight of the final composition, followed by a packaging arrangement configured to wrap a permeable material around individual portion packets. Examples of devices used in such manufacturing are disclosed in e.g., EP 149985 and EP0921978.

The method for packing portion packets of a tobacco or non-tobacco snuff composition having a water content from 10 wt % to 90 wt % based on the total weight of the final composition according to the second aspect of the present invention comprises:

a) applying an adhesive on an interior surface of a container;
b) providing portion packets of a tobacco or non-tobacco snuff composition for oral use having a water content from 10 wt % to 90 wt % based on the total weight of the final composition, wherein said portion packets are individually wrapped in a permeable material;
c) placing the individually wrapped portion packets from step b) into the container in a desired pattern, whereby a contact is established between each of said individually wrapped portion packets and the container at a point where the adhesive has been applied; and
d) sealing the container.

The portion packets may be placed into the container by a positioning unit, such as a positioning unit configured to position the portion packets in a certain pattern.

The portion packets in step b) are individually wrapped in a permeable material, such as to form pouches. The permeable material may be a fabric, such as a woven or non-woven material. An example of a non-woven material is a cellulose based non-woven fabric, such as viscose. The permeable material wrapping the portion packets may be in the form of pouches.

The container may be sealed by providing the base with a top, such as a lid. For example the container is sealed by providing the base with a detachable lid.

The container may also be sealed with a liner covering the open end of the container. The liner could be used in combination with a lid.

The method according to the present invention for packing portion packets of a tobacco or non-tobacco snuff composition having a water content from 10 wt % to 90 wt %, such as from 20 wt % to 60 wt % or from 28 wt % to 56 wt %, of the total weight of the final composition, comprises the steps of:

a) applying an adhesive on an interior surface of a container, such as an adhesive permitting removable adhesion of the portion packets in the container, for example a pressure sensitive hot melt adhesive; for example the adhesive is applied in the form of one or more strands, smeared out, sprayed, or applied in the form of a double-sided adhesive tape;

b) providing portion packets of a tobacco or non-tobacco snuff composition for oral use having a water content from 10 wt % to 90 wt % based on the total weight of the final composition, such as from 20 wt % to 60 wt % or from 28 wt % to 56 wt %, such as moist snuff, for example snus, wherein said portion packets are individually wrapped in a permeable material, such as a fabric, such as woven and non-woven materials, such as a cellulose based non-woven material, for example viscose;

c) placing the individually wrapped portion packets from step b) into the container in a desired pattern, whereby a contact is established between each of said individually wrapped portion packets and the container at a point where the adhesive has been applied; and d) sealing the container.

An example is a method for packing portion packets of a tobacco or non-tobacco snuff composition having a water content from 20 wt % to 60 wt % based on the total weight of the final composition, wherein the method comprises the steps of:

a) applying an adhesive permitting removable adhesion of the portion packets in the container, for example a pressure sensitive hot melt adhesive, on an interior surface of a container, for example in the form of one or more strands;

b) providing portion packets of a tobacco or non-tobacco snuff composition for oral use having a water content from 20 wt % to 60 wt % based on the total weight of the final composition, wherein said portion packets are individually wrapped in a non-woven material;

c) placing the individually wrapped portion packets from step b) into the container in a desired pattern, whereby a contact is established between each of said individually wrapped portion packets and the container at a point where the adhesive has been applied; and d) sealing the container.

The present invention also relates to the use of an adhesive on an interior surface of a container for removable adhesion of portion packets of a tobacco or non-tobacco snuff composition having a water content from 10 wt % to 90 wt % based on the total weight of the final composition, such as from 20 wt % to 60 wt %, for example from 28 wt % to 56 wt %, such as moist snuff, for example snus; wherein said portion packets are individually wrapped in a permeable material. The adhesive may be a pressure sensitive hot melt adhesive. Each portion packet may be individually held in place by the adhesive.

The description, examples and figures have been set forth merely to illustrate the invention and are not intended to be limiting. Without departing from the scope of the idea of the invention it may be modified in various ways which will be apparent to the person skilled in the art.

The invention claimed is:

1. A container comprising:

a container base and a detachable lid, the container base comprising a base surface and a surrounding wall extending upward and away from the base surface to define an interior space, the lid configured to cover the container base when attached to the container; and portion packets of a tobacco or non-tobacco snuff composition disposed within the interior space of the container base, wherein the tobacco or non-tobacco snuff composition comprises a water content from 10 percent by weight ("wt %") to 90 wt % based on the total weight of the tobacco or non-tobacco snuff composition, wherein the portion packets are individually wrapped in a permeable material and held in place on an interior surface of the interior space of the container base by an adhesive suitable for oral use and configured to permit removable adhesion of the portion packets in the container, and wherein the portion packets are arranged in a single layer on the interior surface of the container base such that each portion packet is in direct contact with the interior surface of the container at a point where the adhesive has been applied.

2. The container according to claim 1, wherein the adhesive is a pressure sensitive hot melt adhesive.

3. The container according to claim 1, wherein the permeable material is a fabric.

4. The container according to claim 3, wherein the fabric is a non-woven material.

5. The container according to claim 4, wherein the non-woven material is a cellulose based non-woven material.

6. The container according to claim 1, wherein the water content is from 20 wt % to 60 wt % of the total weight of the tobacco or non-tobacco snuff composition.

7. The container according to claim 6, wherein the water content is from 28 wt % to 56 wt % of the total weight of the tobacco or non-tobacco snuff composition.

8. The container according to claim 1, wherein the tobacco or non-tobacco snuff composition is tobacco or non-tobacco snus.

9. The container according to claim 1, wherein the wrapped portion packets are snus pouches.

10. The container according to claim 1, wherein the container is a snuff box.

11. The container according to claim 1, wherein the container comprises a dosing aperture.

12. The container of claim 1, wherein the container is cylindrical in shape such that the container base and the detachable lid are circular in shape.

13. The container of claim 1, wherein the adhesive suitable for oral use comprises one or more strands of adhesive disposed on the interior surface of the container base.

* * * * *